United States Patent [19]

Levinson

[11] 3,955,168

[45] May 4, 1976

[54] REJUVENATION METHOD FOR VARISTORS

[75] Inventor: Lionel M. Levinson, Schenectady, N.Y.

[73] Assignee: General Electric Company, Schenectady, N.Y.

[22] Filed: Sept. 3, 1974

[21] Appl. No.: 502,908

[52] U.S. Cl. ..... 338/21; 29/575; 264/36; 338/320; 338/334

[51] Int. Cl.[2] ..... H01C 7/13

[58] Field of Search ..... 338/21, 53, 57, 334; 29/575, 401; 219/50

[56] References Cited

UNITED STATES PATENTS

| | | | |
|---|---|---|---|
| 556,408 | 3/1896 | Fay | 338/53 |
| 2,321,523 | 6/1943 | Saslaw | 29/575 |
| 2,356,094 | 8/1944 | Saslaw | 29/575 |

FOREIGN PATENTS OR APPLICATIONS

| | | | |
|---|---|---|---|
| 1,170,046 | 5/1964 | Germany | 338/21 |

OTHER PUBLICATIONS

National Radio Institute Electronics Nonlinear Resistors and Capacitors, p. 2, 1960, N.R.I. Washington, D. C.

*Primary Examiner*—E. A. Goldberg
*Attorney, Agent, or Firm*—Jack E. Haken; Joseph T. Cohen; Jerome C. Squillaro

[57] ABSTRACT

A method of rejuvenating polycrystalline metal oxide varistors whose performance characteristics may have been degraded by prolonged voltage stress is disclosed. The method includes removing voltage stress from the varistors and heating the varistors.

11 Claims, 5 Drawing Figures

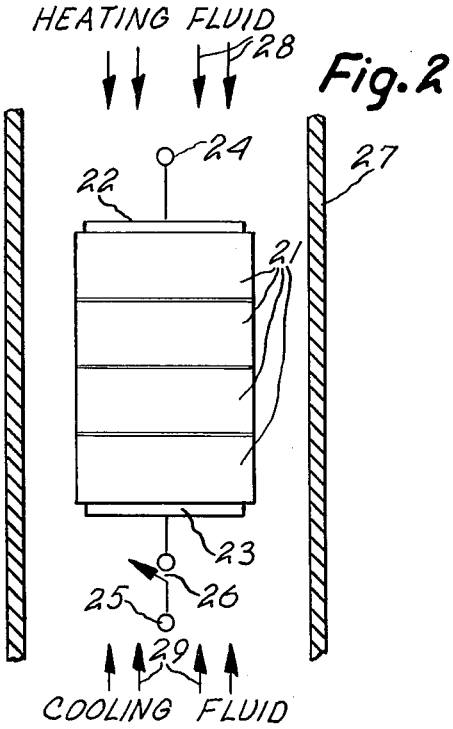
Fig. 2
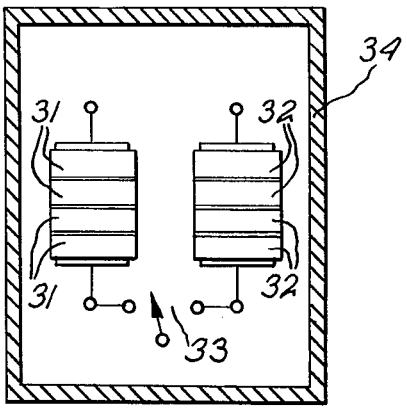
Fig. 3
Fig. 4
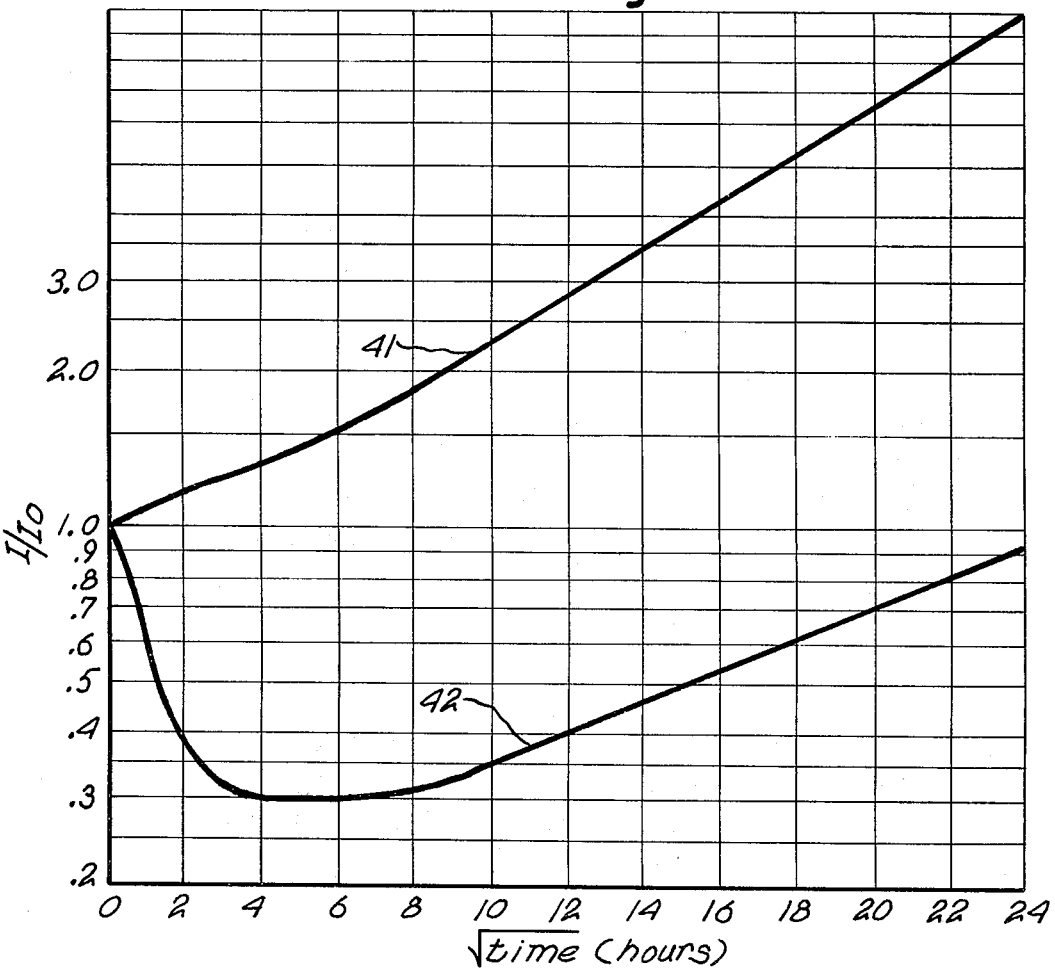

REJUVENATION METHOD FOR VARISTORS

This invention relates to the operation of polycrystalline varistors. More particularly, this invention relates to a method of rejuvenating polycrystalline varistors by heating.

There are a few known substances whose resistance characteristic $\alpha$ is non-linear and is expressed by the equation $$I = \left(\frac{V}{C}\right)^{\alpha}$$

where $I$ is the current flowing through the material, $V$ is the voltage applied across the material, $C$ is a constant which is a function of the physical dimensions of the body, its composition, and the parameters of the process employed to form the body, and $\alpha$ is a constant for a given range of current and is a measure of non-linearity of the resistance characteristic of the body.

A well-known example of such varistor materials is silicon carbide. Silicon carbide and other non-metallic varistor materials are characterized by having an alpha exponent of less than 6. Recently, a family of polycrystalline metallic oxide varistor materials have been produced which exhibit an alpha exponent in excess of 10. These new varistor materials comprise a sintered body of zinc oxide crystal grains, including additionally an intergranular layer of other metal oxides and/or halides, as, for example, beryllium oxide, bismuth oxide, bismuth fluoride, or cobalt fluoride, and are described, for example, in U.S. Pat. No. 3,682,841, issued to Matsuoka et al. on Aug. 8, 1972 and U.S. Pat. No. 3,687,871, issued to Masuyama et al. on Aug. 29, 1972.

In the electric power distribution arts, it is common to provide high voltage surge protective apparatus at various points in a distribution network to protect the elements of the network and apparatus of electric power customers from damage by high energy surges caused, for example, by lightning strikes or transient load anomalies. Spark gaps and silicon carbide varistors have been employed in the past for this purpose. Because of the relatively low alpha exponent, silicon carbide devices employed for surge protection are usually connected in series with spark gaps. Because of their superior varistor performance, the new metal oxide varistor devices are considered able to provide superior performance in voltage transient suppression stacks for power distribution systems.

It has been discovered, however, that polycrystalline metal oxide varistors undergo a degradation in performance characteristics when subjected to prolonged a-c voltage stress. In power distribution system protective devices, a life expectancy of 20 years is required, and the protective devices are subjected to continuous a-c stress. The significant varistor performance characteristic degradation which has been found to occur is an increase in steady state leakage current through the varistor. As a typical example, at a 60°C operating ambient temperature with continuous a-c voltage stress applied, leakage current is found to double in approximately 10,000 hours of operation. Because of the extremely low leakage currents associated with polycrystalline metal oxide varistor devices, the doubled leakage after approximately 10,000 hours is still satisfactory for use in gapless surge protective apparatus, but the leakage will eventually become too great to permit gapless operation.

It is accordingly, an object of this invention to provide a method of rejuvenating polycrystalline metal oxide varistors whose performance characteristics have been degraded by prolonged voltage stress.

It is a further object to provide such a method which is simple and inexpensive to practice.

It is another object of this invention to provide such a method which is fully compatible with present operation and maintenance procedures in the electric power distribution arts.

Briefly, an in accordance with one embodiment of this invention, polycrystalline metal oxide varistors whose performance characteristics have been degraded by prolonged voltage stress are rejuvenated by heating the varistors in the absence of voltage stress.

The novel veatures of this invention sought to be patented are set forth with particularity in the appended claims. The invention, together with further objects and advantages thereof, may be understood from a reading of the following specification and appended claims in view of the accompanying drawings in which:

FIG. 2 is an elevation view, partially in section, illustrating one embodiment for practicing this invention.

FIG. 3 is an elevation view, partially in section, illustrating another embodiment for practicing this invention.

FIG. 4 is a plot of the ratio of leakage current to initial leakage current through a polycrystalline metal oxide varistor device as a function of time.

Figure 1:
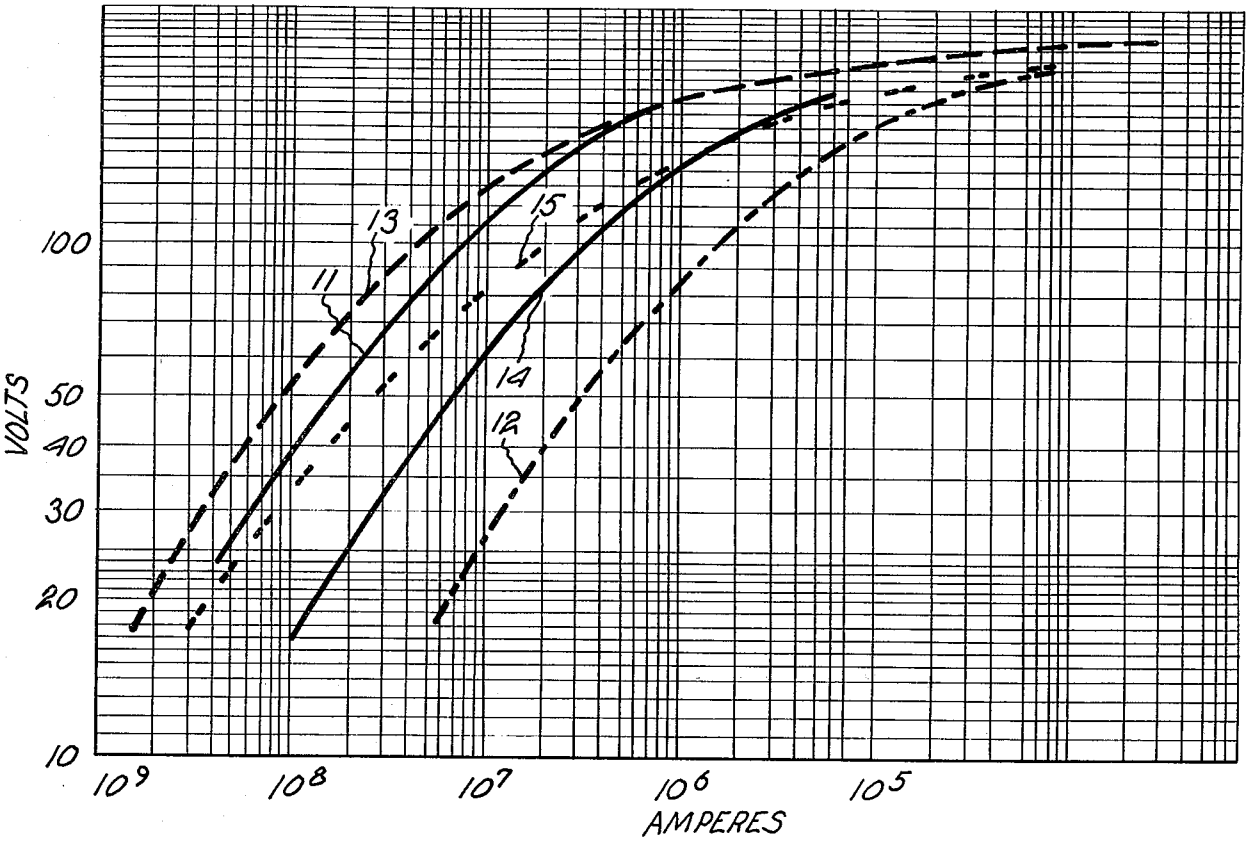
FIG. 1 is a log-log plot of the current-voltage characteristic of a particular sample of polycrystalline metal oxide varistor showing the degradation of characteristics under prolonged a-c stress and the rejuvenation in accordance with this invention over two cycles of aging and rejuvenation.

FIG. 1 illustrates the characteristics of a polycrystalline metal oxide varistor sample measured at various times in two cycles of aging and rejuvenation under differing conditions. Curve 11 is the voltage current characteristic of the sample prior to operation of the varistor. Curve 12 is the voltage current characteristic of the same varistor sample after operation for 650 hours at a temperature of 50°C carrying approximately 2 milliamperes of dissipative current. During this phase of the operation, an unusually high current was forced through the varistor. Under normal operating conditions, leakage currents are typically very much less than 2 milliamperes. The degradation of characteristic between curves 11 and 12 of FIG. 1 may be seen to be quite severe. The varistor sample was then heat-treated at 150°C for a period of 70 hours, after which the voltage current characteristic was again measured and is illustrated in FIG. 1 at curve 13. The improvement in performance characteristics between those illustrated in curve 12 and curve 13 illustrate the efficacy of the rejuvenation method of this invention. After rejuvenation, the sample having the characteristics shown in curve 13 was again subjected to aging, this time at lower leakage current, but still in excess of typical operating parameters. Curve 14 shows the characteristic of the polycrystalline varistor sample after aging at 50°C for 1300 hours with a dissipative leakage current of approximately one-half milliampere. Curve 15 illustrates the characteristic of the sample after heat-treating at 70°C for 500 hours following the measurement of curve 14. FIG. 1 therefore illustrates the following facts pertinent to this invention: the rate of degradation of polycrystalline metal oxide varistor is strongly a function of the current therethrough, the rate of rejuvenation by heat treating is strongly a function of the temperature to which the sample is heated, and the aging-/rejuvenation cycle is repeatable.

Under typical operation conditions, a doubling of leakage current through a varistor device is quite tolerable. As examples of typical operating conditions, a sample operated at a dissipative current density of 0.2 milliamperes/cm$^2$ doubles its leakage current when operated at 60°C in 8,000 hours and doubles its leakage current in 60,000 hours when operated at 40°C. A sample operated at 10 microamperes/cm$^2$ dissipative current density doubles its leakage current in 10,000 at 60°C and in 60,000 hours at 40°C. The rejuvenation of these samples to initial operating characteristics may be accomplished, in accordance with experimental results obtained, by heating the sample degraded at 0.2 milliampere/cm$^2$ initial dissipative current to 80°C for 1400 hours, to 127°C for 50 hours, or 145°C for 17 hours; the sample degraded at 10 microamperes/cm$^2$ initial dissipative current density is rejuvenated by heating to 80°C for 2000 hours, 139°C for 50 hours, or 145°C for 35 hours. Thus, any degree of heating with voltage stress removed will serve to rejuvenate the polycrystalline metal oxide varistor if continued for a long enough time. In fact, it has been further found that the varistor may be rejuvenated by merely removing voltage stress therefrom and subjecting it to the same temperature at which it was operated for the same period of time during which it was aged under voltage stress. Therefore, in accordance with this invention the minimum rejuvenation temperature is approximately the operating temperature of the device when under stress. The maximum rejuvenation temperature in accordance with this invention is determined by practical considerations involving the tendency of the lead-tin solder joints usually employed in connection with the installation of polycrystalline metal oxide varistors to soften; accordingly, it is not advisable to heat the varistors to temperature much above 150°C for rejuvenation in accordance with this invention.

FIG. 2 illustrates apparatus useful for practicing the method of this invention in accordance with one embodiment thereof. In FIG. 2 a stack of varistor elements 21 is provided with end electrodes 22 and 23 connected to terminals 24 and 25 for connection into circuits. The varistor stack is contained within a chimney 27 and connection of the varistor stack into circuit is controlled by switch member 26. Under operating conditions, switch 26 is closed to connect the varistor stack into circuit and as a preferable option, a cooling fluid is blown through chimney 27 as indicated by arrows 29 to reduce the ambient operating temperature of the varistor stack. Under typical operating conditions, the temperature of the varistor stack does not exceed 60°C and, in accordance with the data presented in the preceding paragraph, satisfactory operation for a period of 1 year is obtainable. During the normal annual maintenance of the station equipment, switch 26 is opened to remove voltage stress from the varistor stack and a heating fluid illustrated by arrows 28 is blown through chimney 27 to heat the varistors 21 of the varistor stack for rejuvenation purposes. By selecting the heating temperature to be within the range 125°C to 150°C, rejuvenation of the varistors 21 is obtained during the normal 48 hour annual maintenance. Switch 26 is then closed again and the protective stack is returned to normal operation for another year.

FIG. 3 illustrates apparatus for practicing the method of this invention in accordance with another embodiment thereof. In FIG. 3, two identical series stacks of varistor elements 31 and 32, respectively, are enclosed in a single enclosure 34. Switch member 33 provides for alternative connection of one of the two stacks into circuit. In accordance with this invention, the stacks are connected into circuit alternately for equal periods of time. The stack which is out of circuit is maintained at operating temperature by heat dissipated from the stack which is in circuit and which is contained within enclosure 34. Accordingly, in this case, rejuvenation is obtained by removing voltage stress from the stack undergoing rejuvenation and maintaining it at operating temperature for a period of time equal to the period of time at which it was aged under voltage stress.

Figure 5:
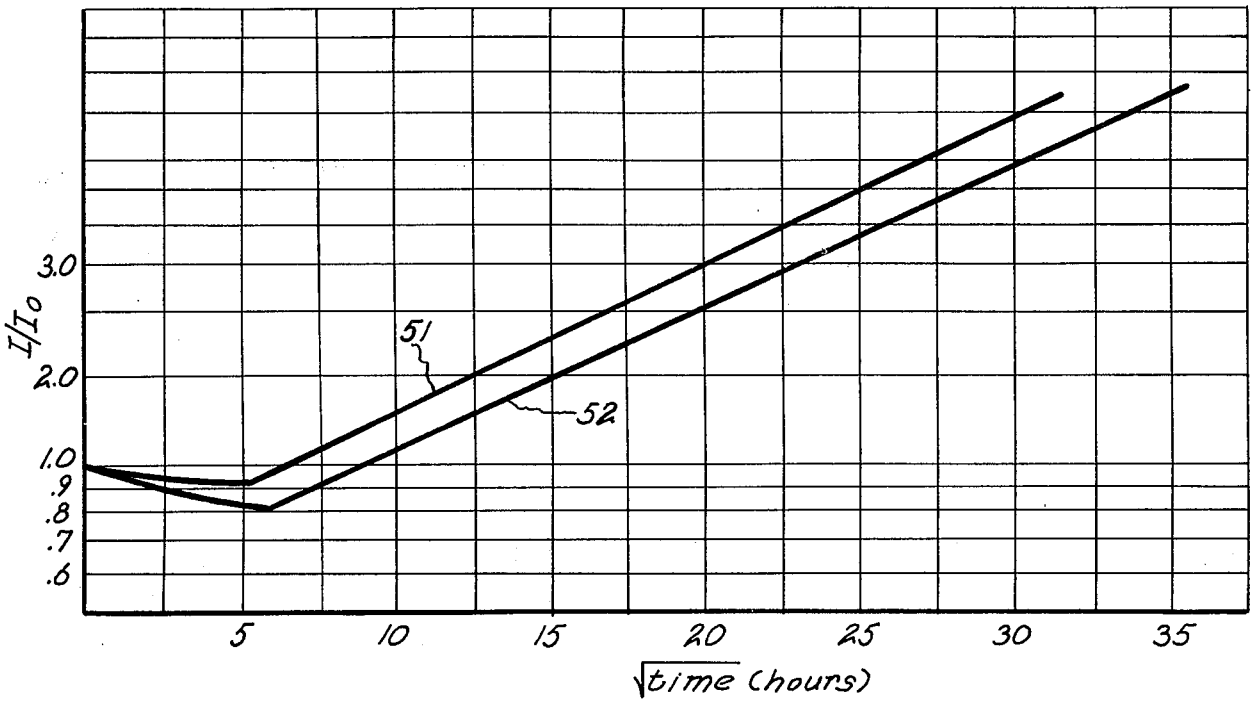
FIG. 5 is a plot of the ratio of leakage current to initial leakage current through a polycrystalline metal oxide varistor device which has been rejuvenated in accordance with this invention as a function of time.

FIGS. 4 and 5 illustrate the degradation of polycrystalline metal oxide varistors under voltage stress with current, and, taken together, illustrate that rejuvenation in accordance with this invention returns a polycrystalline metal oxide varistor to its initial operating characteristic. In FIG. 4, curve 41 represents the ratio of leakage current to initial leakage current as a function of time for a varistor sample operated at 50°C wherein initial leakage current is $1.1 \times 10^{-8}$ amperes. Curve 42 illustrates leakage current to initial leakage current for an idential varistor operated at 50°C wherein initial leakage current is $1.3 \times 10^{-6}$ amperes. Curves 41 and 42 are obtained by measurements made on previously unused varistor samples. Curves 51 and 52 of FIG. 5 were obtained by measurement of samples which had been subject to degradation and rejuvenation. Curve 51 illustrates the ratio of leakage current to initial leakage current at a function of time for rejuvenated varistor operated at 50°C wherein initial leakage current was $2.8 \times 10^{-9}$ amperes. Curve 52 illustrates the ratio of leakage current to intial leakage current for an identical rejuvenated varistor operated at 50°C wherein initial leakage current was $1.5 \times 10^{-6}$ amperes. The similarity of characteristic between FIGS. 4 and 5 illustrates that rejuvenation in accordance with this invention returns varistor devices to essentially the initial operating characteristics and is a repeatable process.

While this invention has been described with reference to particular embodiments and examples, other modifications and variations will occur to those skilled in the art in view of the above teachings. Accordingly, it should be understood that within the scope of the appended claims, the invention may be practiced otherwise than is specifically described.

1. A method of rejuvenating polycrystalline metal oxide varistors comprising the steps of:

removing a voltage stress from polycrystalline metal oxide varistors whose leakage current performance has been degraded by prolonged exposure to said voltage stress and heating said varistors in the absence of said voltage stress until said leakage current performance is rejuvenated.

2. The method of claim 1 wherein said heating step more particularly comprises heating said varistors to a greater temperature than the temperature at which said varistors operated with said voltage stress applied.

3. The method of claim 2 wherein said heating step more particularly comprises holding said greater temperature constant for a period of time.

4. A method of rejuvenating polycrystalline metal oxide varistors comprising the steps of:

removing a voltage stress from polycrystalline metal oxide varistors whose leakage current performance has been degraded by prolonged exposure to said voltage stress;

heating said varistors to a temperature between 120°C and 150°C; and holding said varistors at said temperature for a period between 40 hours and 60 hours.

5. The method of claim 4 further including the step of: repeating said method periodically.

6. The method of claim 5 wherein said method is repeated annually.

7. The method of claim 4 wherein said varistors are contained in a conduit and said heating step more particularly comprises blowing a heating fluid through said conduit.

8. The method of claim 7 further including the step of blowing a cooling fluid through said conduit while applying said voltage stress for normal operation of said varistors.

9. A method of rejuvenating polycrystalline metal oxide varistors comprising the steps of removing a voltage stress from polycrystalline metal oxide varistors, which varistors are contained in a conduit, whose leakage current performance has been degraded by prolonged exposure to said voltage stress; and blowing a heating fluid through said conduit, whereby said varistors are heated in the absence of said voltage stress.

10. A method for operating a plurality of polycrystalline metal oxide varistors contained in a single enclosure comprising the steps of:

operating normally a first set of varistors of a plurality of varistors with voltage stress applied thereto while not applying voltage stress to a second set of varistors of said plurality of varistors for a preselected period of time;

switching said voltage stress from said first set of varistors to said second set of varistors and operating normally said second set of varistors for said preselected period of time;

periodically switching said voltage stress between said first set of varistors and said second set of varistors;

applying heat to varistors in said first set at such times as voltage stress is not applied to said varistors in said first set; and applying heat to varistors in said second set at such times as voltage stress is not applied to said varistors in said second set;

whereby leakage current performance in said varistors, whose performance has been degraded by prolonged exposure to said voltage stress, is rejuvenated.

11. The method of claim 10 wherein the period of said periodic switching is annual.

* * * * *